US006484889B1

(12) United States Patent
Cagner

(10) Patent No.: US 6,484,889 B1
(45) Date of Patent: Nov. 26, 2002

(54) SHOE DISPLAY SUPPORT AND ASSOCIATED METHOD

(75) Inventor: M. Bruce Cagner, Dix Hills, NY (US)

(73) Assignee: BCNY International, Inc., New York, NY (US)

( * ) Notice: Subject to any disclaimer, the term of this patent is extended or adjusted under 35 U.S.C. 154(b) by 0 days.

(21) Appl. No.: 09/518,487

(22) Filed: Mar. 3, 2000

(51) Int. Cl.[7] ..... A47F 7/08
(52) U.S. Cl. ..... 211/34; 206/278; 206/292
(58) Field of Search ..... 211/34; 206/278

(56) References Cited

U.S. PATENT DOCUMENTS 537,853 A * 4/1895 Ramsay ..... 211/34 X
1,700,432 A * 1/1929 Cahill ..... 206/278
1,909,942 A * 5/1933 Fingerman ..... 211/34
1,921,110 A * 8/1933 Wheary ..... 206/278 X
D124,159 S * 12/1940 Stoner ..... D9/346
2,276,765 A * 3/1942 De Gree ..... 206/278
2,333,643 A * 11/1943 Donnellan ..... 206/278 X
2,446,366 A * 8/1948 Epps ..... 206/278 X
2,605,905 A * 8/1952 Willmott ..... 211/34
2,698,689 A * 1/1955 Novack ..... 211/34
2,712,337 A * 7/1955 Tremblay ..... 206/315.1
2,834,460 A * 5/1958 Lee, Jr. et al. ..... 206/294
3,327,924 A * 6/1967 Brutting ..... 383/25
3,348,665 A * 10/1967 Andretich ..... 206/315.1
3,369,660 A * 2/1968 Hartman ..... 206/292
3,414,093 A * 12/1968 Chostner ..... 318/772
4,083,483 A * 4/1978 Bayless ..... 206/278 X
4,126,256 A * 11/1978 McGruder ..... 206/294 X
4,168,871 A * 9/1979 Dierkes ..... 211/34 X
4,795,029 A * 1/1989 Campbell et al. ..... 206/278
5,193,675 A * 3/1993 Otis ..... 206/278
5,390,786 A * 2/1995 Challoner et al. ..... 206/278
5,414,975 A * 5/1995 Hummel ..... 206/287 X
5,456,353 A * 10/1995 Challoner et al. ..... 206/292
5,590,766 A * 1/1997 Carnahan et al. ..... 206/278 X
5,655,669 A * 8/1997 Moore ..... 211/34
5,931,314 A * 8/1999 Jackstat et al. ..... 211/34

* cited by examiner

*Primary Examiner*—Daniel P. Stodola
*Assistant Examiner*—Khoa Tran
(74) *Attorney, Agent, or Firm*—R. Neil Sudol; Henry Coleman; William Sapone

(57) ABSTRACT

A display support or mount for shoes includes a first portion for supporting a first shoe of a pair in a generally upside-down orientation to enable display of a sole of the first shoe. A second portion of the display mount supports a second shoe of the pair in a different orientation. The two portion of the shoe display support are connected to one another. The first portion of the shoe display support includes a substantially planar panel or surface for engaging an ankle lip or rim of the first shoe and further includes an inclined panel coupled to the planar panel for engaging a metatarsal or upper portion of the first shoe. In addition, the first support further includes a substantially vertical panel or wall connected at least indirectly to the planar surface and the inclined surface. The vertical panel or wall serves as a stop or arrest holding a respective shoe from sliding off of the inclined panel or surface. The vertical panel or wall is preferably curved to define a generally oval recess receiving the first shoe. The second portion of the shoe display support also preferably includes a second substantially planar panel or surface and a substantially vertical panel or wall substantially surrounding the second substantially planar panel or surface.

8 Claims, 2 Drawing Sheets

SHOE DISPLAY SUPPORT AND ASSOCIATED METHOD

BACKGROUND OF THE INVENTION

This invention relates to a shoe display support or mount.

It is well known that modern athletic shoes incorporate a number of design features which are functional and/or aesthetic. These design features are frequently viable on the outside of the shoe and represent a significant source of marketing value.

In footwear retain establishments, it is traditional to display shoes on racks or in windows. Usually, one or both members of a pair of shoes are displayed in a normal right-side-up orientation, with the soles in contact with an underlying support surface. Such a display method is satisfactory where the shoes being displayed are dress shoes. In that case, the look and function of the shoes is adequately apprehended by a visual inspection of the shoe uppers. However, where the shoes have a sole with unusual, utilitarian or ornamental features, those features are generally hidden and not observable when the shoes are displayed in the traditional fashion.

OBJECTS OF THE INVENTION

It is an object of this invention to provide a shoe support or mounting member which facilitates a display of both shoes of a matching pair.

Another particular object of the present invention is to provide such a shoe support or mounting member which enables display of both shoes of the pair in different orientations.

It is another object of the present invention to provide a shoe support or mount which enables display of a shoe underside or sole.

A further object of the present invention is to provide such a shoe support or mounting member which is easy and inexpensive to manufacture.

Yet another object of the present invention is to provide such a shoe support or mounting member which is which may be incorporated into a shoe box.

It is an additional object of the present invention to provide a method for displaying a pair of shoes.

These and other objects of the present invention will be apparent from the drawings and descriptions herein.

SUMMARY OF THE INVENTION

The present invention is directed in part to a shoe support or display which facilitates the display of at least one shoe of a matched pair so that the underside or sole of the shoe is visible to a viewer on casual inspection. Where the soles of the shoes have unusual, utilitarian or ornamental features of possible interest to a potential consumer, displaying at least one shoe in a substantially upside-down orientation serves to promote the shoes and pique the interest and desire of the consumer.

In the present invention, the shoe support is preferably a unitary molded piece insertable in a shoe box so that the shoes are predisposed in an attractive display configuration accessible merely by removing the lid of the box.

A display mount for shoes comprises, in accordance with the present invention, a first support for supporting a first shoe of a pair in a generally upside-down orientation to enable display of a sole of the first shoe, a second support for supporting a second shoe of the pair in a different orientation, and a connection element connecting the first support and the second support to one another.

The first support preferably includes a substantially planar panel or surface for engaging an ankle lip or rim of the first shoe and further includes an inclined panel coupled to the planar panel for engaging a metatarsal or upper portion of the first shoe. In addition, the first support further includes a substantially vertical panel or wall connected at least indirectly to the planar surface and the inclined surface. The vertical panel or wall serves as a stop or arrest holding a respective shoe from sliding off of the inclined panel or surface. The vertical panel or wall is preferably curved to define a generally oval recess receiving the first shoe.

The second support also preferably includes a second substantially planar panel or surface for engaging the second shoe. The planar panels or surfaces of the first and second shoe supports are generally coplanar and continuous with one another. The second support further includes an additional substantially vertical panel or wall substantially surrounding the second substantially planar panel or surface.

As mentioned above, the first support, the second support means and the connection element are preferably all parts of an integrally molded support body made of a synthetic resin or polymeric material. However, it is within the contemplation of the instant invention that the planar support surfaces are formed by the lower panel of a shoe box, while the inclined surface and substantially vertical surfaces of the two shoe supports are parts of an integrally molded polymeric support body disposed in the shoe box.

The orientation of the second shoe is generally either a right-side-up orientation or a sideways orientation. In any case, the vertical sidewall of the respective shoe support is adapted to hold the shoe in the desired orientation. A rectangular configuration is effective where the second shoe is disposed in an upright orientation.

A display support for shoes comprises, in accordance with another conceptualization of the present invention, a support body having an upper surface and at least one recess depending downwardly from the upper surface. The support body has an inclined surface contiguous at an upper end with the upper surface. The recess is defined in part by the inclined surface. The support body also has a substantially vertical surface contiguous with the upper surface. The recess is also defined in part by the substantially vertical surface.

In accordance with another features of the present invention, the recess is a first recess, whereas the support has a second recess also depending downwardly from the upper surface. Likewise, the substantially vertical surface is a first substantially vertical surface of the display support, the support body having a second substantially vertical surface defining the second recess.

Pursuant to further features of the present invention, the second recess is substantially prismatic, and more particularly has the shape of a right rectangular prism, while the second recess and the first recess communicate with one another via an opening in the support.

Where the support body includes an upwardly facing floor surface, the first recess and the second recess are defined in part by the floor surface, while the substantially vertical surfaces are contiguous with the floor surface.

As discussed hereinabove, the shoe display mount may additionally comprise a shoe box, with the support body being disposed inside the box.

A related method in accordance with the present invention for displaying a pair of shoes utilizes a shoe support. One shoe of a matched pair is disposed in a substantially upside-down orientation on the shoe support, while the other shoe of the matched pair is disposed on the support in a given different orientation. The shoe support is preferably provided in a box containing the shoes of the pair disposed in the upside-down orientation and the different orientation, respectively. The method then further comprises removing a lid from the box to reveal the shoes.

A shoe support in accordance with the present invention provides a shoe display which is easy to install. The shoes are disposed on the display at the factory or by the shipper. The display support is part of the shoe package. Every pair of shoes has its own display. It is only necessary that the lid be removed to show a pair of shoes with at one member of the pair in an upside-down orientation to display the design of the shoe soles.

A shoe display mount or support in accordance with the present invention is inexpensive and easy to manufacture an insert in a shoe box. Shoes are simply deposited in a respective recesses to provide the appropriate display.

DESCRIPTION OF THE PREFERRED EMBODIMENTS

Figure 1:
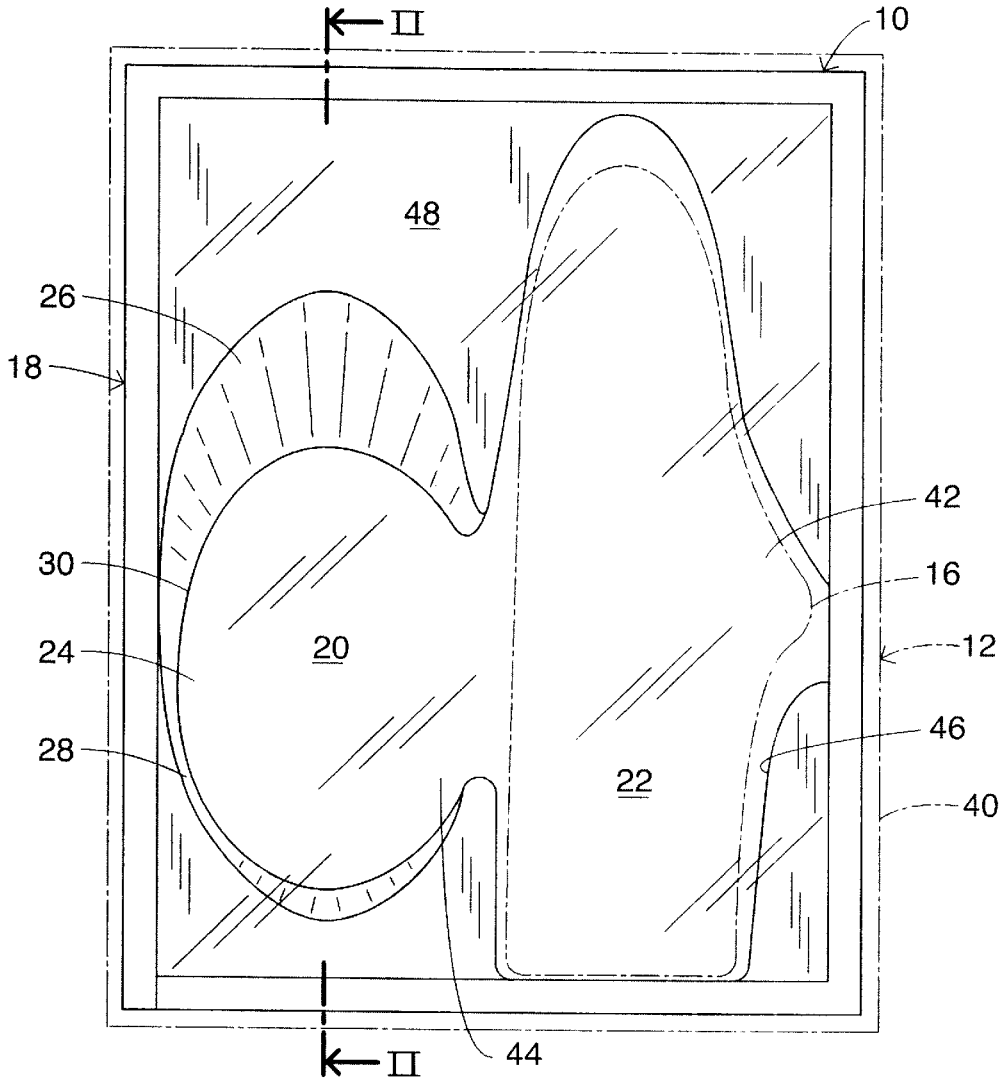
FIG. 1 is a top plan view of a shoe display support or mount in accordance with the present invention.
Figure 2:
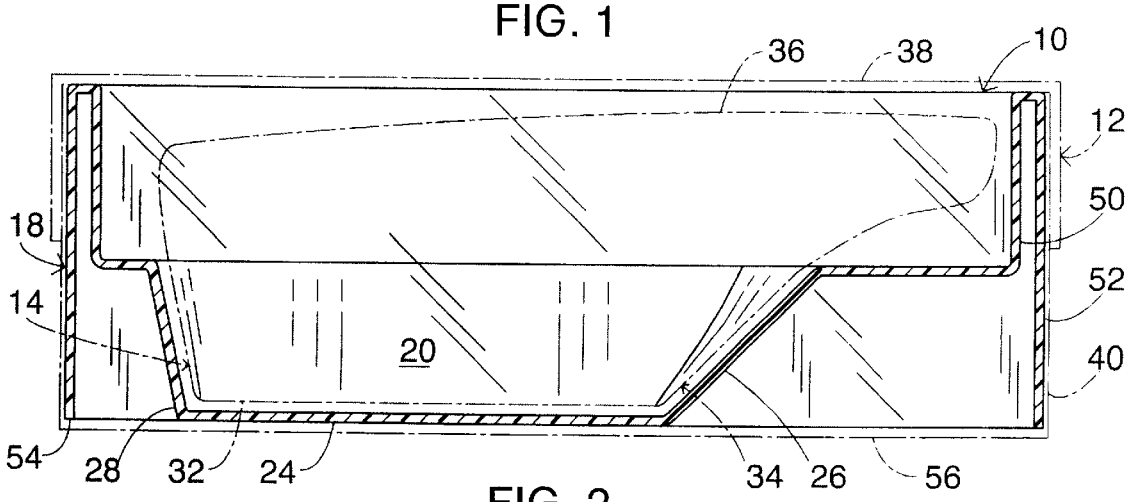
FIG. 2 is a cross-sectional view taken along line II—II in FIG. 1.

As illustrated in FIGS. 1 and 2, a shoe display support 10 made of moldable polymeric material is inserted into a shoe box 12 and shipped inside the box together with a pair of shoes 14 and 16. Support 10 includes a unitary molded body 18 defining an oval recess 20 for holding one shoe 14 (FIG. 2) in an upside-down orientation and an elongate recess 22 for holding the other shoe 16 on its side (FIG. 1).

Recess 20 is defined in part by a planar lower panel or surface 24, an inclined panel or surface 26, and a curved substantially vertical panel or wall 28. Substantially vertical panel or wall 28 is contiguous with and connected to planar lower panel 24 and inclined panel 26. Panels 26 and 28 are substantially continuous with one another and are connected to planar lower panel 24 along a C-shaped joint line 30.

Planar lower panel or surface 24 engages an ankle lip or rim 32 of shoe 14, while inclined panel 26 is in contact with a metatarsal or upper portion 34 of shoe 14. Thus, a sole or lower surface 36 of shoe 14 faces upwardly so as to be accessible to casual visual inspection after removal of a lid 38 from a main portion 40 of shoe box 12. Vertical panel or wall 28 serves as a stop or arrest preventing shoe 14 from sliding off of inclined panel or surface 26.

Recess 22 is defined in part by a second substantially planar panel or surface 42 on which shoe 16 rests on its side. Panels or surfaces 24 and 42 are coplanar and continuous with one another along a neck region 44. Recess 22 is further defined by a substantially vertical panel or wall 46 which substantially surrounds planar lower panel or surface 42.

Support body 18 further includes a planar shelf panel or ledge surface 48 which is contiguous with an joined to inclined panel 26 and vertical walls 28 and 46. Recess 20 and 22 are located in and depend from shelf panel or ledge surface 48. Shelf panel or ledge surface 48 thus generally surrounds recesses 20 and 22 and is surrounded by a wall 50 in turn surrounded by and connected to a perimetric rectangular skirt 52. Skirt 52 fits snugly into main portion 40 of box 12 and has a lower edge 54 resting on a bottom panel 56 of box 12.

Figure 3:
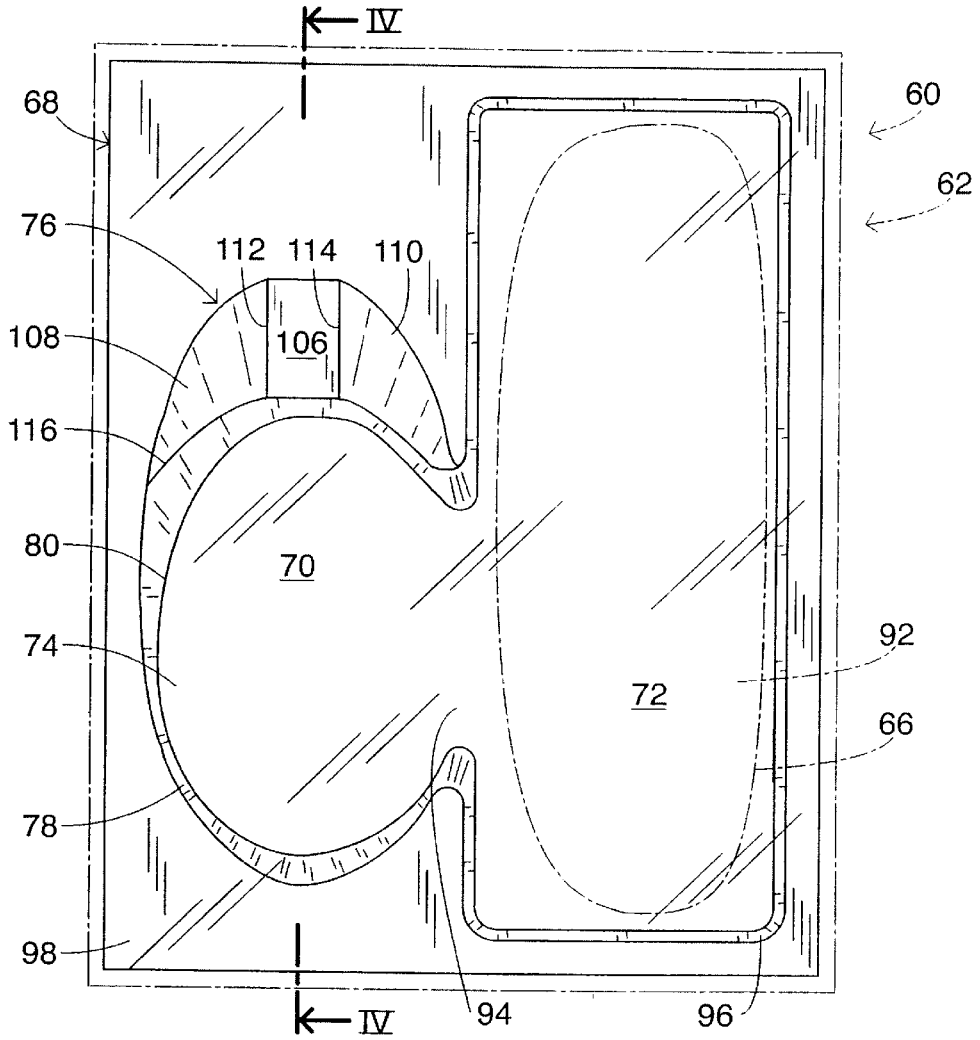
FIG. 3 is a top plan view of another shoe display support or mount in accordance with the present invention.
Figure 4:
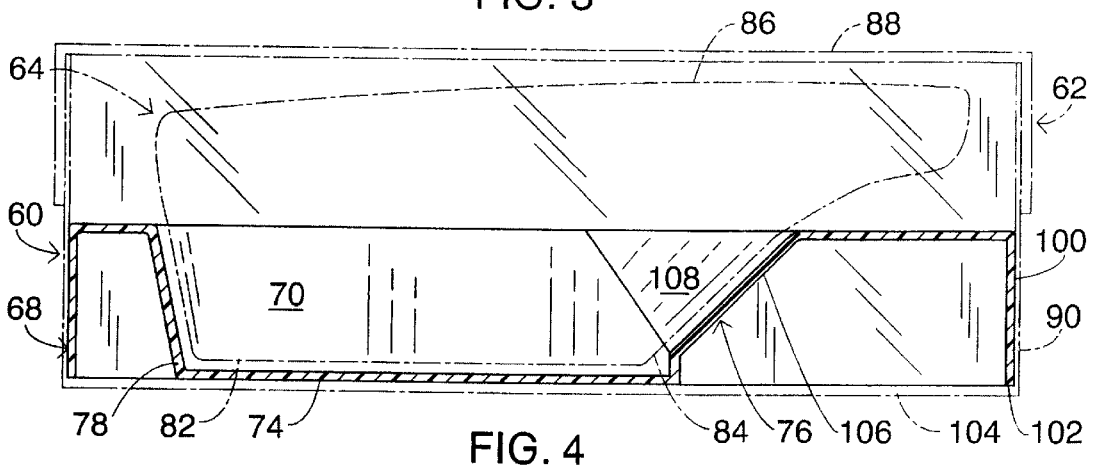
FIG. 4 is a cross-sectional view taken along line IV—IV in FIG. 3.

As illustrated in FIGS. 3 and 4, an other shoe display support 60 made of moldable polymeric material is inserted into a shoe box 62 and shipped inside the box together with a pair of shoes 64 and 66. Support 60 includes a unitary molded body 68 defining a generally oval recess 70 for holding one shoe 64 (FIG. 4) in an upside-down orientation and an elongate prismatic or rectangular recess 72 for holding the other shoe 66 in an upright orientation (FIG. 3).

Recess 70 is defined in part by a planar lower panel or surface 74, an inclined panel or surface 76, and a curved substantially vertical panel or wall 78. Vertical panel or wall 78 is contiguous with and connected to planar lower panel 74 and inclined panel 76. Panel 76 includes a central planar section 106 and a pair of substantially cylindrically curved sections 108 and 110 disposed on opposite sides of central section 106 and connected thereto along respective joint lines 112 and 114. Inclined panel 76 is connected to vertical panel or wall 78 along a joint line 116, while panel or wall 78 is connected to planar lower panel 74 along a C-shaped joint line 80.

Planar lower panel or surface 74 engages an ankle lip or rim 82 of shoe 64, while inclined panel 76 is in contact with a metatarsal or upper portion 84 of shoe 64. Thus, a sole or lower surface 86 of shoe 64 faces upwardly so as to be accessible to casual visual inspection after removal of a lid 88 from a main portion 90 of shoe box 62. Vertical panel or wall 78 serves as a stop or arrest preventing shoe 64 from sliding off of inclined panel or surface 76.

Recess 72 is defined in part by a second substantially planar panel or surface 92 on which shoe 66 rests on its side. Panels or surfaces 74 and 92 are coplanar and continuous with one another along a neck region 94. Recess 72 is further defined by a substantially vertical panel or wall 96 which substantially surrounds planar lower panel or surface 92.

Support body 68 further includes a planar shelf panel or ledge surface 98 which is contiguous with and joined to inclined panel 76 and vertical walls 78 and 96. Recesses 70 and 72 are located in and depend from shelf panel or ledge surface 98. Shelf panel or ledge surface 98 thus generally surrounds recess 70 and 72 and is connected to a perimetric rectangular skirt 100. Shirt 100 fits snugly into main portion 90 of box 62 and has a lower edge 102 resting on a bottom panel 104 of box 12.

Although the invention has been described in terms of particular embodiments and applications, one of ordinary skill in the art, in light of this teaching, can generate additional embodiments and modifications without departing from the spirit of or exceeding the scope of the claimed invention. For example, it is quite possible to carry out a display method in accordance with the invention, using a different support structure. An alternative support may, for instance, comprise a generally upwardly projecting horn insertable partially into one shoe of a pair for supporting the shoe in a generally upside-down orientation. The support may further include a platform for supporting the other shoe of the pair in a right-side-up orientation or a side-panel-up position. The position of this other shoe may be determined in part by a vertical wall formed, for example by side panels of shoe box.

A shoe display support in accordance with the invention may alternatively comprise an array of projections extending upwardly from a platform or panel, the projections having varying sizes and locations to support one shoe in a substantially upside-down orientation and the other shoe in a different orientation.

A planar panel or surface at the bottom of a recess for supporting a shoe may be formed by a lower panel of a shoe box in which a shoe display mount is displayed together with a pair of shoes.

Accordingly, it is to be understood that the drawings and descriptions herein are proffered by way of example to facilitate comprehension of the invention and should not be construed to limit the scope thereof.

What is claimed is:

1. A shoe display assembly comprising:

a shoe box including a lower part and a lid covering an opening in said lower part;

a shoe display support inserted into said lower part of said shoe box, said support including a unitary molded body defining an oval first recess and an elongate second recess;

a first shoe disposed on said support, said first shoe being disposed in an upside-down orientation in said first recess so that a sole of said first shoe faces said opening; and a second shoe disposed on said support, said second shoe being disposed in said second recess in a respective orientation different from said upside-down orientation.

2. The display assembly defined in claim 1 wherein said support includes a substantially planar panel or surface for engaging an ankle lip or rim of said first shoe and further includes an inclined panel for engaging a metatarsal or upper portion of said first shoe, said planar panel or surface being oriented parallel to a bottom panel of said lower part of said shoe box, said inclined panel being oriented at an acute angle relative to said planar panel or surface and relative to said bottom panel, said inclined panel or surface partially defining said first recess.

3. The display assembly defined in claim 2 wherein said support further includes a substantially vertical panel or wall connected at least indirectly to said planar panel or surface and said inclined panel, said vertical panel or wall being oriented substantially perpendicularly relative to said planar panel or surface and relative to said bottom panel.

4. The display assembly defined in claim 1 wherein said lid is disposed below and about said lower part to expose said first shoe and said second shoe on said support.

5. The display assembly defined in claim 1 wherein said first shoe and said second shoe are disposed side by side and adjacent to one another.

6. The display assembly defined in claim 1 wherein said respective orientation is taken from the group consisting essentially of a right-side-up orientation and a sideways orientation.

7. The display assembly defined in claim 1 wherein said first recess and said second recess communicate with one another so that said first recess and said second recess are portions of a single recess.

8. The display assembly defined in claim 1 wherein said shoe support includes a planar upper surface and vertical walls or panels at least partially defining said first recess and said second recess.

* * * * *